United States Patent [19]

Kawade

[11] Patent Number: 5,055,016

[45] Date of Patent: Oct. 8, 1991

[54] ALLOY MATERIAL TO REDUCE WEAR USED IN A VANE TYPE ROTARY COMPRESSOR

[75] Inventor: Tsuneshige Kawade, Kanagawa, Japan

[73] Assignee: Atsugi Unisia Corporation, Tokyo, Japan

[21] Appl. No.: 525,717

[22] Filed: May 21, 1990

[30] Foreign Application Priority Data

May 19, 1989 [JP] Japan ..... 1-57056[U]

[51] Int. Cl.[5] ..... F04C 18/344; F04C 29/00

[52] U.S. Cl. ..... 418/179; 75/230

[58] Field of Search ..... 418/178, 179; 75/230, 75/231, 243, 246

[56] References Cited

U.S. PATENT DOCUMENTS

| | | | |
|---|---|---|---|
| 3,827,920 | 8/1974 | Shimoda et al. | 418/179 |
| 4,388,114 | 6/1983 | Suganuma et al. | 75/243 |
| 4,616,985 | 10/1986 | Hattori et al. | 418/178 |
| 4,729,729 | 3/1988 | Tarumoto et al. | 418/179 |
| 4,815,953 | 3/1989 | Iio | 418/179 |
| 4,844,738 | 7/1989 | Tanase et al. | 75/241 |

FOREIGN PATENT DOCUMENTS

| | | | |
|---|---|---|---|
| 62-48983 | 3/1987 | Japan | 418/179 |
| 62-108588 | 7/1987 | Japan . | |
| 63-88294 | 4/1988 | Japan | 418/179 |

*Primary Examiner*—Richard A. Bertsch
*Assistant Examiner*—David L. Cavanaugh
*Attorney, Agent, or Firm*—Ronald P. Kananen

[57] ABSTRACT

A vane-type rotary compressor having wear and seizure resistance is disclosed comprising a cam ring having a cylindrical interior, a rotor rotatably installed in said cam ring, a vane arranged on the circumference of said rotor for radial movement toward and left from inner periphery of said cylindrical interior of said cam ring, and a pair of plates secured to corresponding front and rear portions of said cam ring to cover it, said cam ring and said rotor being formed of silicon rich aluminium alloy containing 12 to 20 wt % of silicon, said pair of plates being formed of aluminium or aluminium alloy, and said vane being formed of ferric sintered materials containing 3 to 8 wt % of carbon.

3 Claims, 5 Drawing Sheets

ALLOY MATERIAL TO REDUCE WEAR USED IN A VANE TYPE ROTARY COMPRESSOR

BACKGROUND OF THE INVENTION

1. Field of the Invention

The present invention relates generally to a vane-type rotary compressor. More specifically, the present invention relates to a vane-type rotary compressor with improved interior materials are improved.

2. Description of the Prior Art

Japanese Utility Model First Publication (Jikkai) No. 62-108588 discloses a well known conventional vane-type rotary compressor. In this compressor, a front plate and a rear plate are set into a cylinder (cam ring) and a front housing having a pair of induction chambers is fitted at the front portion of the front plate. On the other hand, a rear housing is secured to a rear portion of the front housing and an oil separating chamber is formed in the rear portion thereof. A rotor fitted into a shaft is rotatably installed in the cylinder. This rotor is formed of an aluminium-type material. In the outer surface of the rotor, vane slits are formed, then vanes are movably and slidably equipped in the vane slits. These vanes are formed of ferric materials having components of 89 wt % of Fe, 1 wt % of C, 8 wt % of Mo, and 2 wt % of Ni, then sintered so that vanes having a structure including voids can be obtained.

When the rotor is rotated, each vane is rotated corresponding to rotation of the rotor, slidably contacting the inside surface of the cylinder, and compression is performed. In this stage, vanes are impregnated with oil as they include many voids. When lubricant oil becomes short, the oil impregnated in vanes percolates from the voids formed in the vanes to the inner surface of the cylinder so as to lubricate the surfaces between the cylinder and the rotor.

However, in the afore-mentioned vane-type rotary compressor, determination of the component ratio of materials is very difficult. Practically, in the afore-mentioned compressor, sintered materials such as ferric materials having components of 89 wt % of Fe, 1 wt % of C, 8 wt % of Mo and 2 wt % of Ni are used for vanes, and aluminium-type materials are used for the rotor. Wear resistance and/or seizure resistance of the rotor depends on the component ratio of the aluminium-type material. Additionally, in conventional use, materials for the cylinder (cam ring) are not limited as to specific materials, therefore, the wear resistance of the cylinder also depends on the component ratio of its materials. While operating the rotary compressor, surfaces of the rotor and the cam ring where they slidably contact respective surfaces of the vanes sometime suffer from extreme wearing and/or seizure.

SUMMARY OF THE INVENTION

Therefore, the principal object of the present invention is to provide a vane-type rotary compressor having excellent wear and seizure resistance under all operating conditions.

It is another object of the present invention to provide suitable material for componant parts which slidably contact each other while in operation.

A vane-type rotary compressor having wear and seizure resistance according to the present invention comprises: a cam ring having a cylindrical interior, a rotor rotatably installed in the cam ring, a plurality of vanes arranged on the circumference of said rotor for radial movement toward and away from the inner periphery of said cylindrical interior of said cam ring, and a pair of plates secured to corresponding front and rear portions of the cam ring to cover it.

The cam ring and the rotor are formed of silicon rich aluminium alloy containing 12 to 20 wt % silicon, the pair of plates are formed of aluminium or aluminium material, and the plurality of vanes are formed of ferric sintered material containing 3 to 8 wt % carbon. The plates may be coated where they contact with side surfaces of the vanes and the rotor.

The vanes may be formed to have many voids which can be used to impregnate a lubricant into the vane's structure, and the lubricant can be percolated from the voids to an outer surface of the vane when a lubricant applied on the vane's surface becomes short, or depleted.

According to the present invention, as vanes are formed with ferric type sintered material containing 3 to 8 wt % of carbon and the cam ring and rotor are formed with silicon rich aluminium alloy, they fit very well together and do not wear mating portions of each other. Therefore, wear and/or seizure resistance of vanes to friction induced by the cam ring and the rotor can be greatly increased and the reliability of the compressor according to the invention can be improved substantially over conventional compressors.

BRIEF DESCRIPTION OF THE DRAWINGS

The present invention will be understood more fully from the detailed description given hereinbelow and from the appended drawings of the preferred embodiment of the invention, which are given by way of example only, and are not intended to be limitative of the present invention.

In the drawings.

DETAILED DESCRIPTION OF THE INVENTION

Figure 1:
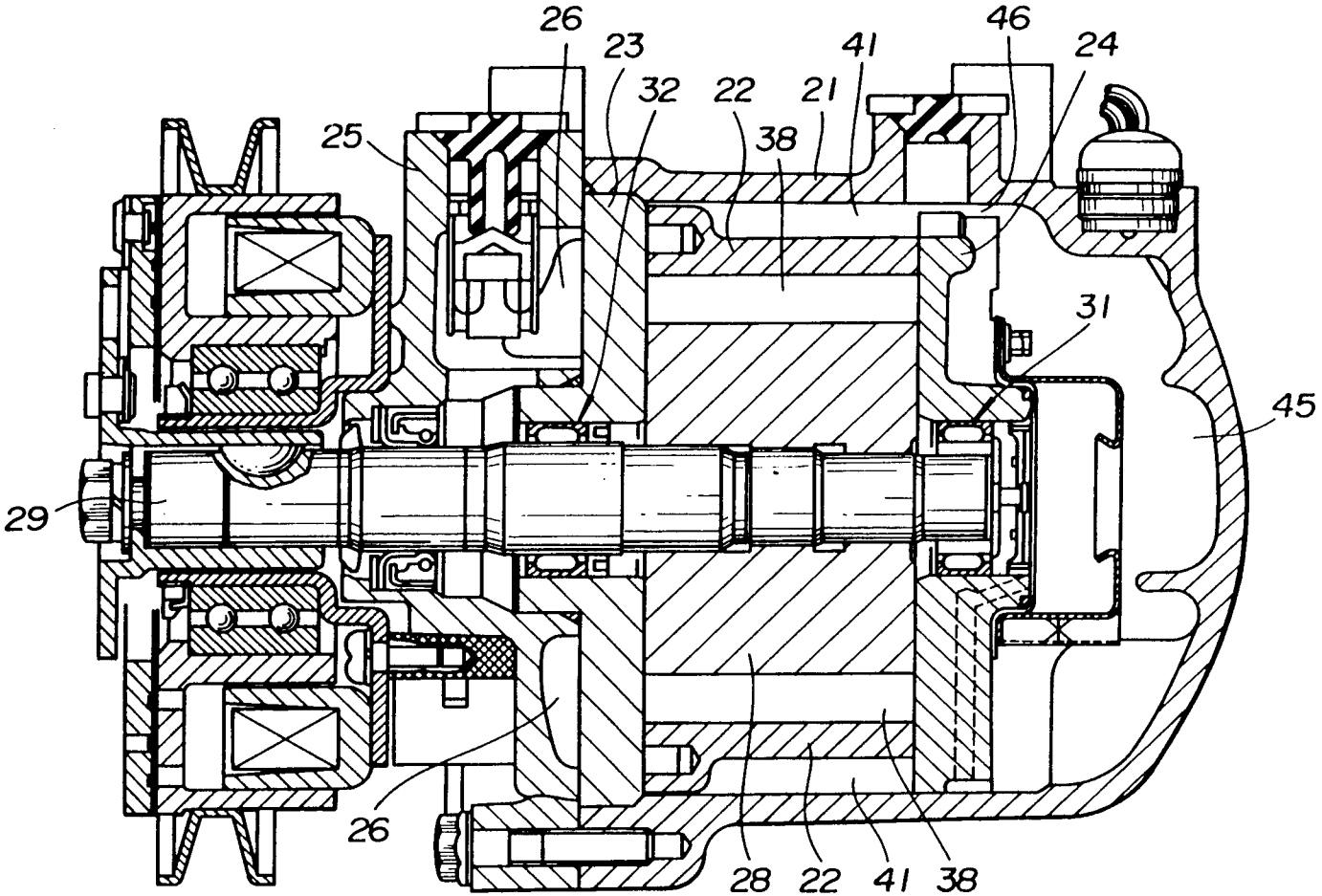
FIG. 1 is a cross-sectional view of a vane-type rotary compressor according to the present invention.
Figure 2:
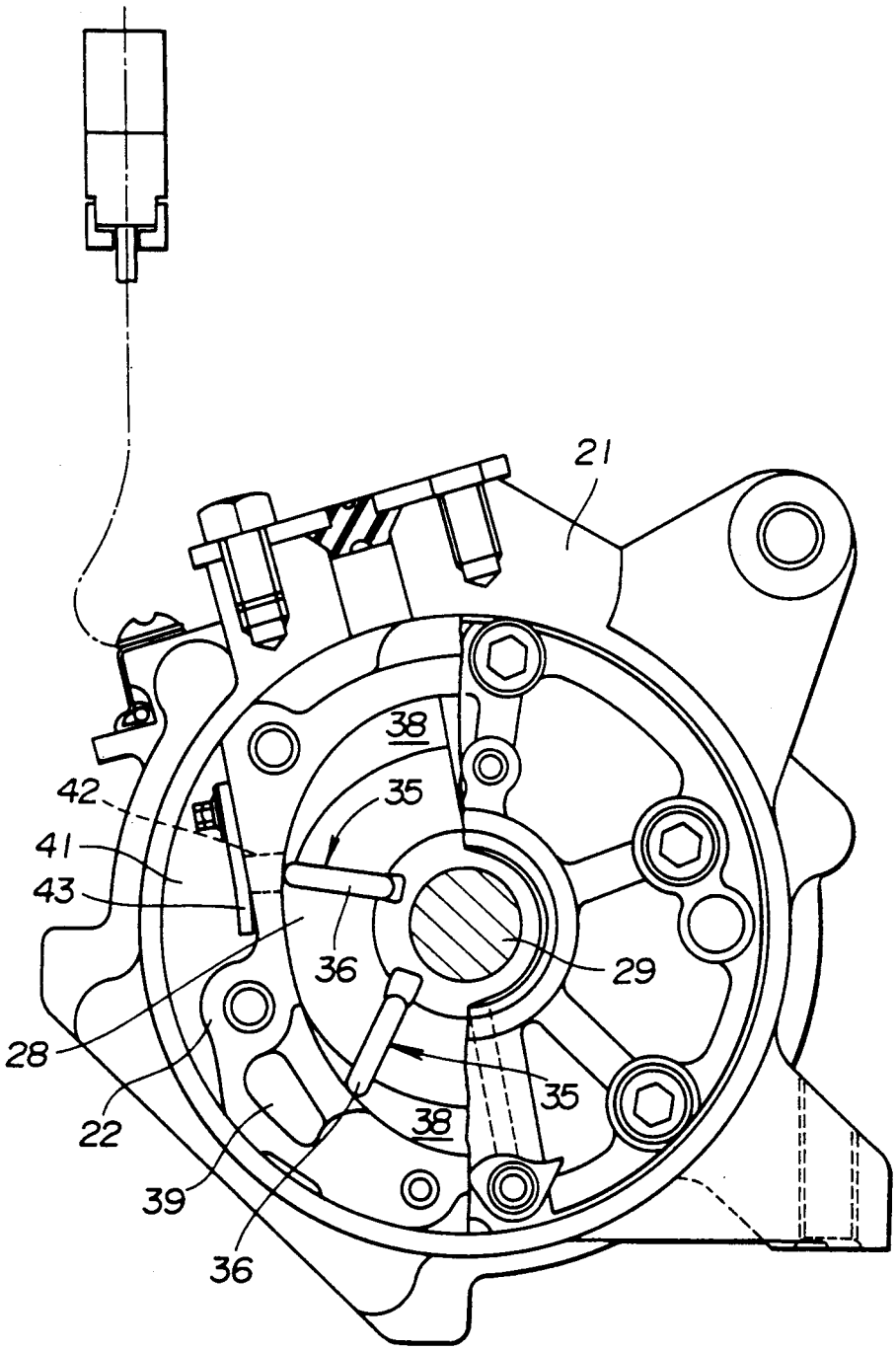
FIG. 2 is a front view of FIG. 1 which is partially broken away to show the uncovered structure.

FIG. 1 and FIG. 2 show the schematic structure of the vane-type rotary compressor of the present invention.

In FIGS. 1 and 2, the numeral 21 generally designates a housing. As illustrated, a cam ring 22 having a cylindrical interior is installed in the housing 21. A front plate 23 and a rear plate 24 are secured to corresponding front and rear portions of the cam ring 22. A head cover 25 is secured to the outside of the front plate 23. A pair of induction chambers 26 are formed between the head cover 25 and the front plate 23.

A rotor 28 is installed in the cam ring 22 supported rotatably by a shaft 29 which is also supported rotatably by needle bearings 31 and 32 at the rear plate 24 and the front plate 23, respectively. In the rotor 28, a plurality of vane slits 35 are formed in the radial direction, and vanes 36 are fitted into the vane slits 35 to move radially in the direction of the vane slits 35.

A pair of cylindrical spaces are formed between the inner surface of the cam ring 22 and the rotor 28. These spaces are formed in a compressing chamber 38 sealed by the cam ring 22, the rotor 28, each vane 36, and both of plates 23, 24.

An induction path 39 which enables communication the induction chamber 26 and the compressing chamber 38 is formed, in the front plate 23. A discharge path 42 which enables communication between the compressing chamber 38 and the discharge chamber 41, spaced between the housing 21 and the cam ring 22, is formed in the cam ring 22. A discharge valve 43 is positioned at the open side of the discharge path 42 where discharge chamber 41 is formed. An oil separating chamber 45, which separates oil from fluid such as coolant, installed between the housing 21 and the rear plate 24. The chamber 45 is in communication with the discharge chamber 41 by a fluid path 46.

The front and rear plates 23 and 24 are formed of aluminium or an aluminium-type alloy (AC2A, for example). The surface of each plate 23, 24 where they slidably contact with the side surfaces of the vanes 36 and the rotor 28 are subjected to coating. Plating treatments using metals such as iron, nickel-phosphine or chromium are suitable for this surface coating. It is also preferable to use a plating technique such as an electorolytic composite dispersion type, using SiC, BN or $Si_3N_4$ as a dispersant, as a coating.

The shaft 29 engaging the rotor 28 is formed of ferric materials (SCM420H, for example). The rotor 28 is formed of silicon rich aluminium alloy containing 12 to 20 wt % of silicon, and the cam ring 22 is also formed of silicon rich aluminium alloy but containing 17 to 20 wt % of silicon. The cam ring and rotor are not subjected to coating.

The vanes 36 are formed of ferric sintered materials having wear and seizure resistance against the silicon rich aluminium alloy of the cam ring 22 and the rotor 28 containing 2 to 8 wt % carbon. As the vane 36 formed of the above-mentioned materials has a carbon rich structure, a void ratio which indicates the oil impregnation ratio of the structure becomes in the range of 5 to 15 wt %. This material is composed of a ferric material containing 3 to 8 wt % carbon, 0.5 to 1.5 wt % copper, 0.5 to 1.5 wt % silicon. Heating treatment such as quenching or tempering is performed in order to raise the hardness of the parts using this material. Additionally, granulation, in which a plurality of carbon grains are adhered to one crystal unit of iron is also performed.

The vane-type rotary compressor having a structure and composition as specified above, operates as follows:

Fluid such as coolant in the induction chamber 26 is suctioned into the compressing chamber 38 via the induction path 39 accompanied by rotation of the rotor 28 and the vanes 36 installed therein. Then the suctioned fluid is compressed and discharged via the discharge path 42 and the discharge valve 43 to the discharge chamber 41, and then flows into the oil separating chamber 45 via the fluid path 46. Oil contaminating the fluid is extracted in the oil separating chamber 45 and fluid only is fed out of the compressor.

The vanes 36 which slidably contact the inner surface of the cam ring 22 are also rotated and repeat a sliding, reciprocating (extending and retracting) motion in the vane slits 35. At this time, the vanes 36 rub strongly at the inner surface of the cam ring 22 and the inner surfaces of the vane slits 35. The oil impregnated in the vanes 36 is percolated from the voids formed in the vanes due to their carbon rich structure, and acts as a lubricant, so resistance is greatly reduced, therefore, seizure which is generally caused by depletion of lubricant can be prevented.

Figure 3:
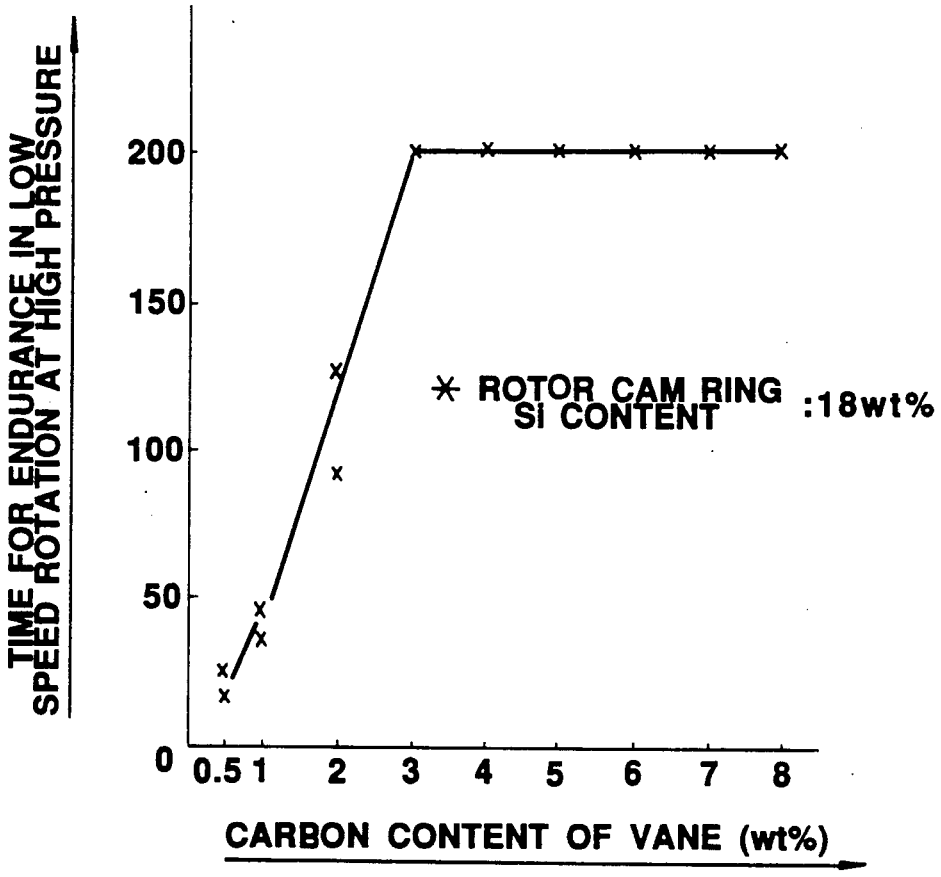
FIG. 3 is a graph showing the relationship between the seizure time for the rotor and the cam ring using 18 wt % Si, and the carbon content (wt %) of the vane in the vane-type rotary compressor of the invention.

FIG. 3 shows the relationship between the time required for seizure and the carbon content of the vane. In this test, material containing 18 wt % silicon was used for the cam ring 22 and the rotor 28. In this case, using material containing at least 3 wt % carbon for the vane. As the graph indicates, seizure did not occur even if operation continued for 200 hours.

Figure 4:
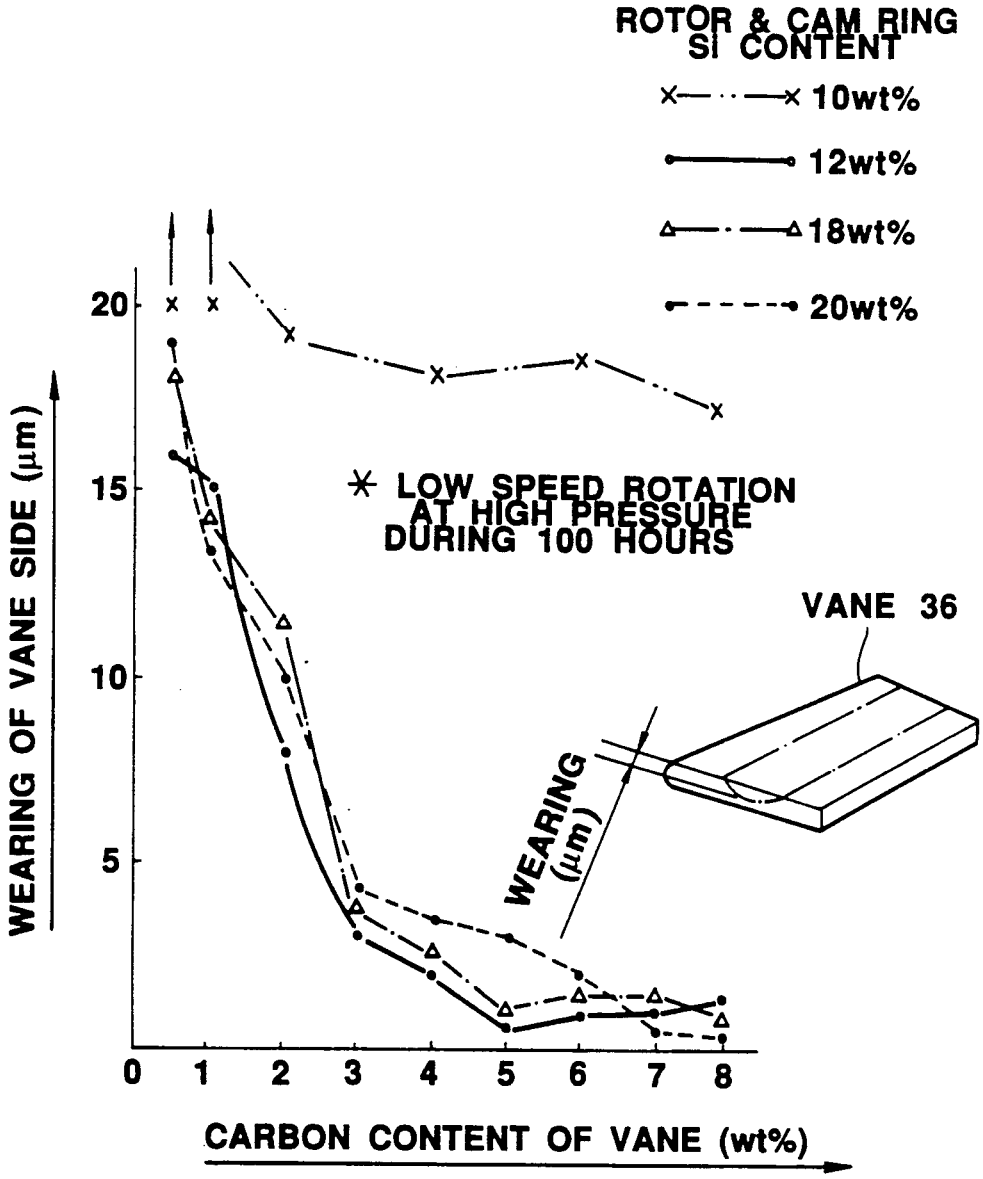
FIG. 4 is a graph showing the relationship between the wearing of a side surface of the vane (μm) and the carbon content (wt %) of the vane.

FIG. 4 shows the results of wear measurements of the vane 36. It indicates that, when using a rotor and cam ring composed of materials containing 12, 18 and 20 wt % of silicon, wearing of the vane was negligible if it contained at least 3 wt % carbon. The wearing amount becomes larger as temperature becomes greatly increased due to friction. Seizure occurred in parts subjected to this friction. Therefore, the results shown in FIG. 4 indicate the seizure resistant properties of the vane from the viewpoint of the wearing amount thereof.

Figure 5:
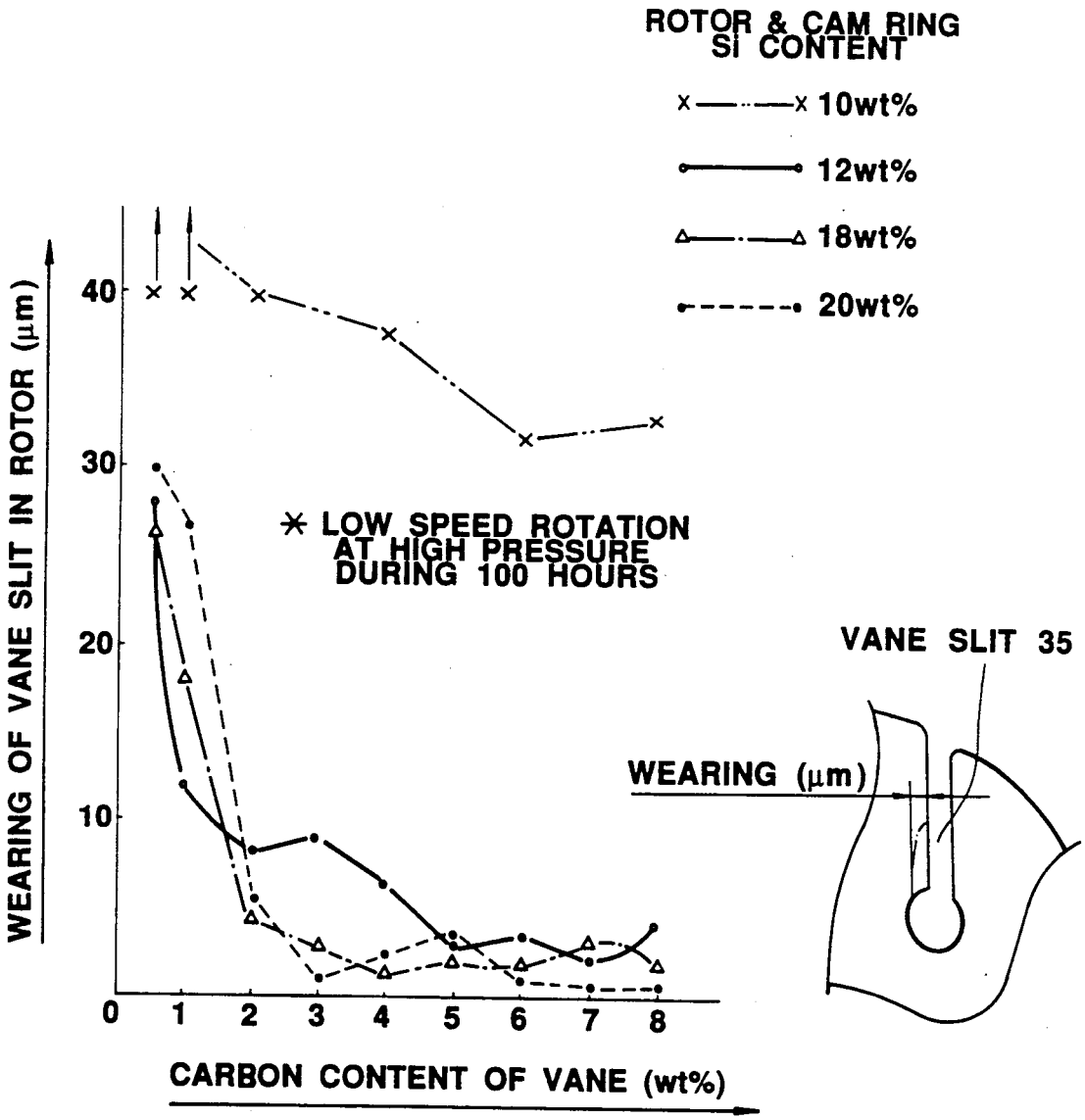
FIG. 5 is a graph showing the relationship between the wearing of the vane slit in the rotor (μm) and the carbon content (wt %) of the vane.

FIG. 5 shows the results of measuring the wear amount of a vane slit 35 installed in the rotor 28. It indicates when using a rotor and a cam ring composed of material containing 12, 18 and 20 wt % silicon, the wearing amount of the vane slit became small if the vane contained at least 3 wt % carbon. Similar to the results of FIG. 4, the results shown in FIG. 5 indicate the seizure resistant properties of the vane slit in the rotor from the viewpoint of the wearing amount thereof.

Additionally, as the front and rear plates 23 and 24 were coated, wearing between these plates and the vane was substantially reduced.

What is claimed is:

1. A vane-type rotary compressor having wear and seizure resistance, comprising:

a cam ring having a cylindrical interior;

a rotor rotatably installed in said cam ring;

a vane arranged on the circumference of said rotor for radial movement toward and away from the inner periphery of said cylindrical interior of said cam ring;

a pair of plates secured to corresponding front and rear portions of said cam ring to cover it;

said cam ring and said rotor being formed of silicon rich aluminum alloy containing 12 to 20 wt % silicon;

said pair of plates being formed of aluminum or aluminum alloy;

said vane being formed of ferric sintered materials containing 3 to 8 wt % carbon; and wherein the silicon content included in said cam ring and said rotor is determined in relation with the carbon content included in said vane for establishing effective wear and seizure resistance.

2. The vane-type rotary compressor as set forth in claim 1, wherein said pair of plates are coated by metal plating which metals are selected from the group consisting of iron, nickel-phosphine or chromium, said plates being coated where contact occurs with side surfaces of said vanes and said rotor.

3. The vane-type rotary compressor as set forth in claim 1, wherein said pair of plates are coated by electrolytic plating using dispersant which is selected from the group consisting of SiC, BN or $Si_3N_4$, said plates being coated where contact occurs with side surfaces of said vanes and said rotor.

* * * * *